US006059150A

United States Patent [19]

Fuchs et al.

[11] Patent Number: 6,059,150

[45] Date of Patent: May 9, 2000

[54] MEDIA DISPENSER HAVING A PLURALITY OF FLOW OPERATING STATES

[75] Inventors: Karl-Heinz Fuchs, Radolfzell; Hans Merk, Gaienhofen-Horn, both of Germany

[73] Assignee: Ing. Erich Pfeiffer GmbH, Radolfzell, Germany

[21] Appl. No.: 09/089,753

[22] Filed: Jun. 2, 1998

[30] Foreign Application Priority Data

Jun. 3, 1997 [DE] Germany ..... 197 23 133

[51] Int. Cl.[7] ..... B65D 88/54

[52] U.S. Cl. ..... 222/321.2; 222/321.9

[58] Field of Search ..... 222/321.2, 321.3, 222/321.9

[56] References Cited

U.S. PATENT DOCUMENTS

| | | | |
|---|---|---|---|
| 4,046,495 | 9/1977 | Grimm, Jr. | 417/268 |
| 4,375,266 | 3/1983 | Magers | 222/321 |
| 4,420,101 | 12/1983 | O'Neill | 222/212 |
| 5,560,520 | 10/1996 | Grogen | 222/321.2 |

FOREIGN PATENT DOCUMENTS

| | | |
|---|---|---|
| 0 345 132 A1 | 5/1989 | European Pat. Off. . |
| 3517558 A1 | 11/1986 | Germany . |
| 8906 136.5 | 8/1989 | Germany . |
| 4441263 A1 | 5/1996 | Germany . |

OTHER PUBLICATIONS

German search report in Appln. No. 197 23 133.0, dated Nov. 24, 1997.

European search report dated Sep. 14, 1998 in Appln. No. 98109321.4–2308.

*Primary Examiner*—Gregory L. Huson

*Attorney, Agent, or Firm*—Quarles & Brady LLP

[57] ABSTRACT

A valve (10) such as an outlet valve of a dispenser comprises a valve body (30) movable from the closing rest position in opposite directions to effect two open positions, namely e.g. one for venting a pumping chamber (8) and the other for discharging the liquid medium from this pressure chamber (8). Thereby the valve (10) opening as a function of pressure may also be automatically opened when a relative low pressure is predominant.

25 Claims, 2 Drawing Sheets

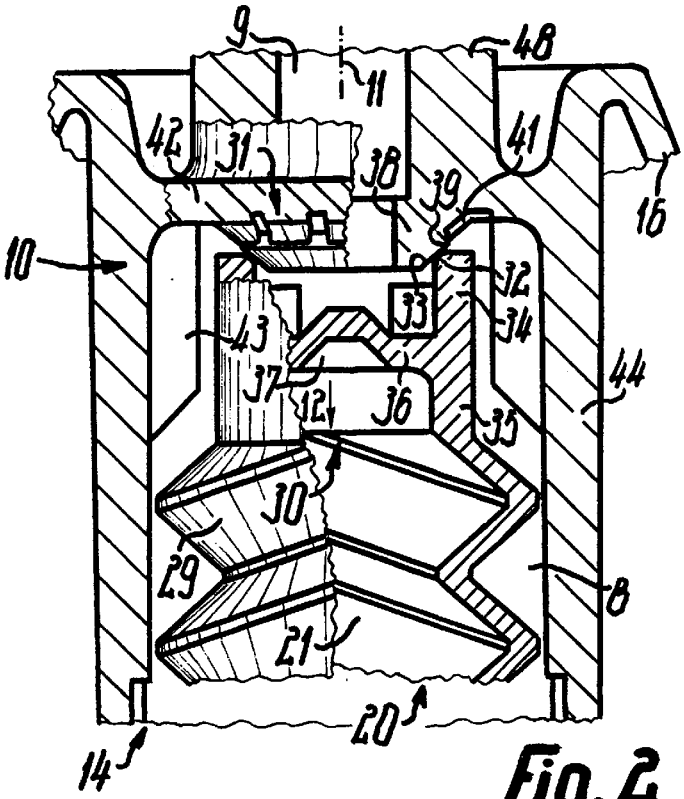
Fig. 2
Fig. 3
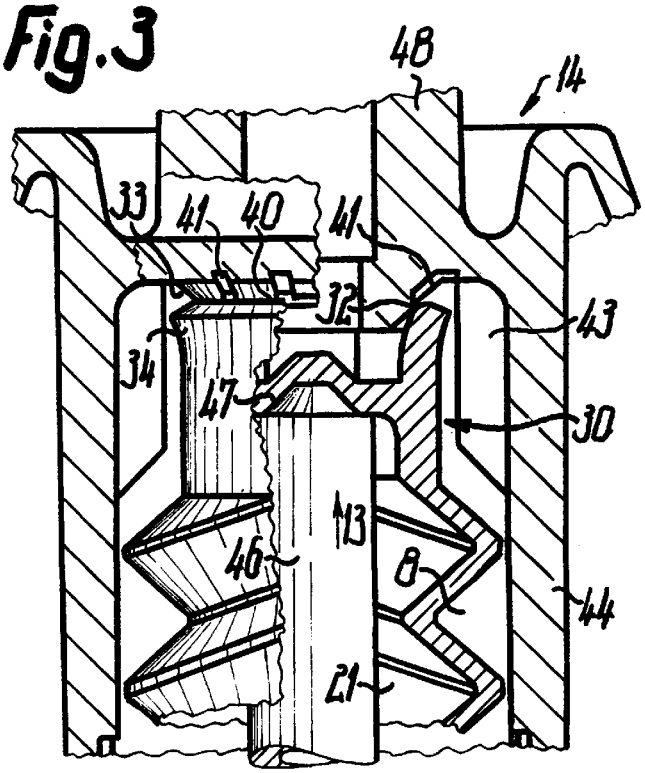

MEDIA DISPENSER HAVING A PLURALITY OF FLOW OPERATING STATES

TECHNICAL FIELD AND BACKGROUND OF THE INVENTION

The invention relates to a media dispenser, in particular for flowable media or fluids which may be liquid, powdery, gaseous, and/or pasty or similar.

For regulating media motions or flow within the dispenser or device a sole or more control devices such as valves can be provided. With them flow cross-sections for the flow can be reversibly flared and constricted, e.g. closed off pressure-tight. Such control means may be an inlet valve for repeatedly sucking the medium from the medium reservoir, an outlet valve for freeing exit of the medium from the dispense, a vent valve for venting a medium chamber or the like. In the rest or initial position of the valve its flow cross-section is constricted or maximally narrowed, e.g. closed relative to the usually widened state. As compared to this, in its flared working or operating position the flow cross-section allows the medium to flow through in flow direction which may also be defined by the flow direction at the inlet and/or outlet of the valve or the like.

OBJECTS OF THE INVENTION

An object is to avoid the drawbacks of prior art designs. A further object is to ensure simple actuation of the control means in achieving different operating positions, for example to permit the passage of differingly compressible media in sequence.

SUMMARY OF THE INVENTION

Means are provided for translating the control device by actuation beyond the rest position into a work position in which the flow cross-section is also constricted or closed relative to that of the rest position. In case the rest position defines the minimum possible flow cross-section instead of the maximum possible flow cross-section the latter is widened in the further working state. A correspondingly widened work position is also adjustable by actuating the control means in the opposite direction. The flow cross-section is then larger than in the first work position. The rest position is located between the work positions. Stopping faces abut the rest position. By manually increasing this inherently stable abutting pressure or by overloading in the closing direction the control device is transferred into one work position, the stopping faces then sliding on each other without need to lift off from each other. By mutually lifting off the stopping faces against spring force the further work position is achieved. The control device is then actuated by the pressure of the medium or fluid instead of directly mechanically manually.

The invention is suitable for venting a pressure chamber, such as the pumping chamber of a thrust piston pump, namely for priming on first operation of the dispenser. On priming the pressure chamber still filled with gas or air needs to be filled by suction from a reservoir or the like with a lesser compressible or incompressible medium. Simultaneously with filling it needs venting to escape the more compressible gas through the flow cross-section of the control device. For that the gas is firstly precompressed manually, before the control device manually translates from the rest or closed state to the cited opened work position to thus allow the gas to exit. Thereafter the control device is reclosed and directly thereafter the volumetrically variable pressure chamber re-expanded in forming a vaccum so that the medium is sucked thereinto. Once the pressure chamber is sufficiently filled with medium after several, for example maximally seven, such strokes, the medium pressure resulting from the next stroke is sufficient to open the control device as an outlet valve operating as a function of pressure and to output the medium through the medium outlet.

Translating the control device or the valve to one of the work positions, particularly to the venting position, involves a control motion oriented transverse to that motion of the two valve bodies or stop faces which they execute on opening and closing during the other operations. The transverse motion may be a deforming motion, a resilient tensioning motion, a sliding motion or the like. Monostabel spring loading of the valve is provided. For that separate springs act against each other so that upon release from outer forces the valve automatically returns from each work position to the rest position.

Both valve springs are formed by deformable shells of plastic, are coaxial and are in one part with each other or of different length. The one spring acts as an axial spring and the other as a radial spring.

When translating to the venting position or the like, the mutually adjoining stop or control faces execute a mutual transverse or rotary motion overlapping or directly advancing the mutual axial motion. Thereby transfer from dead friction to slide friction is accelerated and facilitated. For this the axial spring may be simultaneously a torsion spring which with increasing axial tension also receives increasing torsional stresses and transfers them to the corresponding valve body or the adjoining stop or control faces.

Transfer of the valve to the venting position or the like is done positively only after a first partial stroke of the dispenser. At the end of that a rigid driver abuts to automatically and mutually move the valve bodies after priming or venting this driver also positively causes at the end of each pump stroke fast closing of the valve when open as a function of pressure. Thus passage of the medium is abruptly ended.

BRIEF DESCRIPTION OF THE DRAWINGS

Example embodiments of the invention are explained in more detail in the following and illustrated in the drawings in which:

FIG. 2 is a sectional enlarged view of FIG. 1 in the initial position, and FIG. 3 is the section of FIG. 2, but in a working or venting position.

DETAILED DESCRIPTION

Figure 1:
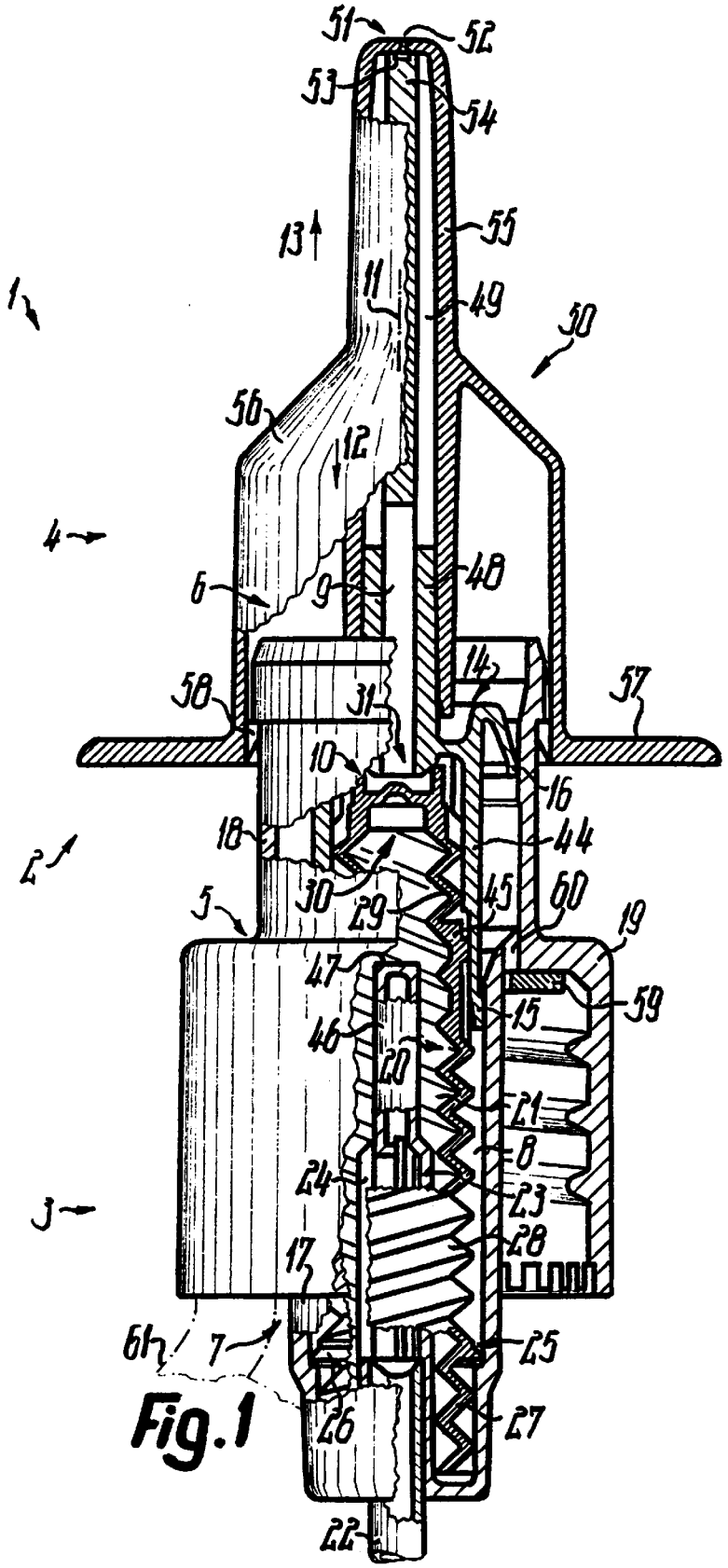
FIG. 1 is a partial axial section of the dispenser according to the invention.

The dispenser 1 comprises a manual discharge actuator 2 by both of its device units 3, 4 or the base bodies 5, 6 thereof being movable linearly as well as reversibly relative to each other. Thereby a thrust piston pump 7 is actuated. The pump or pressure chamber 8 is located totally within base body 5. Unit 3 is to be rigidly fixed to a reservoir vessel. From the pressure chamber 8 the medium flows through a control device or an outlet valve 10 into an outlet duct 9 which passes through base body 6 of unit 4. With unit 4 duct 9 is movable relative to unit 3, 5 over the pump stroke. The cited arrangements are located substantially in a main axis 11 of device 1. The actuating direction 12 of unit 4 and the counter directional flow direction 13 in duct 9 are oriented parallel to axis 11.

Unit 4 or base body 6 comprises an integral piston unit 15 with a pump piston 15 and a sealing piston 16 which are shiftable in directions 12, 13 in a pump casing 17. Adjoining body 17 in direction 13 a casing section 18 extends from casing 17 in direction 13 and has widened inner and outer cross-sections. The inside of section 18 is in the rest position sealingly contacted by sealbody with a sealing lip 16 freely extending in direction 12 (FIG. 1). Lip 15 is spaced in direction 12 from lip 16 and sealingly contacts the inner circumference of constricted casing section 17. Besides body sections 17, 18 integral base body 6 forms a fastener member 19 for securing to the reservoir indicated dot-dashed in FIG. 1. Fastener 19 is a cap for overlapping the reservoir neck and for tensioning base body 5 on this neck by a thread or the like. The end wall of the cap adjoins the transition between body sections 17, 18. The cap shell surrounds body section 17 over the majority of its length so that each of counter directional body sections 17, 18 protrudes over either of the remote sides of the end wall. Instead of a crimp ring may be provided for tensioning.

Arranged totally in the interior of units 3, 4 or of base body 5, 6 and in axis 11 is a separate integral unit 20 of a plastic material. Unit 20 divides the internal space of body section 17 over the full length thereof as well as the internal space of unit 14 up to valve 10 into two chambers in a nested arrangement. One is the annular pressure chamber 8 enveloping the other inner chamber 21. Adjoining the end of body section 17 located withing the reservoir in axis 11 is an inlet passage, for example a flexible riser 22 which is continued within chambers 8, 21 into a duct elongation, for example a stud 23 located in axis 11. Stud 23 is integral with body section 17, and juts from the end wall, traversed by riser 22 only in direction 13 (FIG. 1) up into plunger unit 14. The shell of stud 23 is longitudinally slotted to form outlets 24 through which the medium is able to pass from stud 23 into chamber 21. From annular chamber 21 the medium flows in direction 12 up to the associated end of body section 17 or of unit 20. There medium is opposingly deflected in direction 13 and transferred into chamber 8 via inlet valve 25 after a short flow path.

Valve 25 located at the associated end of tube 22 in axis 11 comprises a valve body 26 or flat ring integral with unit 20. on the inner circumference of body section 17 a valve seat or stop is provided for body 26. Movable valve body 26 can sealingly abut against the force of spring 27 and counter to further motions in direction 12. Tubularly closed flexible spring 27 is integral with dimensionally rigid valve body 26 and surrounds the stud 23, extends from the valve body 26 only in direction 12, is permanently axially pretensioned and is supported by its free end remote from valve body 26 at the inner side of the end wall of body section 17 via radial ribs. In direction 13 a further spring 28 directly adjoins and juts from valve body 26. The end of this spring points in direction 13 and is fixed in the vicinity of piston lip 15 at the inner circumference of the unit 14 axially and against rotation. Thus the permanently preloaded spring 28 acts as a radial spring for returning units 3, 4 to the rest position.

Likewise in axis 11 and between the cited fixing and valve 10 a further permanently preloaded spring 29 is located totally within unit 14. Spring 28 is longer than springs 27, 29 and valve spring 29 is shorter than spring 27. All springs 27 to 29 are integral with each other or with unit 20 and they form the shell of unit 20 which is non-permeable to the medium. This shell has a constant thickness throughout the region of springs 27 to 29. On the inner and outer circumference this shell forms a single or multiple coarse pitch thread. So any changes in the length of the springs simultaneously result in torsional stresses about axis 11 or in mutual torsional motions of the two associated spring ends. Valve element 26 and spring 27 are slightly twisted relative to section 17 by spring 28 which shortens.

Valve 10 comprises a valve body 30 movable with unit 4, 6 and relative thereto. Valve body 30 is located in axis 11 and between plungers 15, 16 totally within unit 14, is movable relative thereto in directions 12, 13 and is integral with spring 29 or unit 20. Body 30, which is H-shaped in axial section, is located nearer to plunger 16 than to plunger 15 and directly adjoins the associated end of spring 29 with a dimensionally rigid shell section. Second valve body 31 is firmly seated on unit 4, 6, is integral with unit 15 and is dimensionally rigid whilst being penetrated by the corresponding end of duct 9. In the rest and closed position valve elements 30, 31 are mutually sealingly in contact with their annular control or valve faces 32, 33 under tension of spring 29. Then the connection between chamber 8 and duct 9 is closed.

Body 30 comprises an outermost shell 34, 35 which is sealingly closed by transverse wall 36 integrally adjoining its inner circumference with spacings from its shell ends.

Shell section 35 freely protrudes from wall 36 in direction 12 and is like wall 36 dimensionally rigid. With its associated end section 35 directly integrally connects to the end of spring 29. The wall thickness of spring 29 is less than that of shell 34, 35 or that of wall 36. Shell section 34 freely protrudes from wall 36 in direction 13 and forms at its free end like at the transition between its inner circumference and its end face the control face 32 rounded in cross-section in the form of a partial or quarter circle. At its side facing chamber 8, 21 the wall 36 may be provided with a centering member, for example a conical depression located in axis 11. Like projections 34, 35 also valve body 31 forms a projection or annular shell 38 freely protruding in direction 12. At the outer circumference or the transition between its end face and its outer circumference shell 38 provides the control face 33. Control face 33 is inclined relative to axis 11 and to directions 12, 13 and is an obtuse external cone which for face 32 forms a control edge 39 located in a ring zone. When according to FIG. 3 control face 32 gains access to the region of edge 39, a passage 40 is opened between faces 32, 33. Thus a first medium flow, for example air, is able to flow from chamber 8 through passage 40 to the inside of shell 34 and from there in direction 13 into duct 9.

As of edge 39 the control face 33 is penetrated by duct depressions 41 or slots uniformly distributed about axis 11 and forming the passage 40. In direction 12 valve body 31, 38 protrudes beyond an end wall 42 of unit 14. Within plunger 16 wall 42 integrally adjoins the inner circumference of a shell 44 which integrally connects pistons 15, 16 and envelopes valve bodies 30, 31. Plunger 16 surrounds plunger jacket 44 which in turn includes on its inner circumference guide members, e.g. axial ribs 43, for centered guiding of body 30 on the outer circumference of shell 34, 35. Spaced in direction 12 from valve body 30 spring 29 adjoins a sleeve-shaped, dimensionally rigid fastening section 45 of unit 20. Section 45 is fixed to the inner circumference of shell 44 by axial insertion.

A positively driving member 46 is provided totally within chamber 8, 21 for transposing valve body 30 to the working or venting position as shown in FIG. 3. Coupling member 36 freely protrudes in direction 13. Driver 46 engages by a stop 47 valve body 30 when in its closed position, namely only face wall 36, but only at the end of the actuating or pump stroke of units 3, 4. Driver 46 is formed by a slimmer mandrel projection of stud 23. This projection adjoins outlets 24, is hollow and integral with the associated end wall of body section 17 or with base body 5. The outermost end face of driver 46 forms stop 47. In FIG. 1 stop 47 is entirely planar and in FIG. 3 it has a conical projection which for centering fit is adapted to opening 37.

It is not until unit 4 has been moved in direction 12 over the full pump stroke relative to unit 3 that stop 47 rigidly engages body 30. Then chambers 8, 21 have reached their minimum volume. Should unit 4 be moved after this even less than one millimeter in direction 12 then control face 32 is slidingly moved along face 33 from its closing an rest position up to edge 39 while expanding. Then passage 40 is opened. At the end of this control motion valve bodies 30, 21 mutually and positively or rigidly come into contact, for example with ribs. These ribs entegrally adjoin the inner circumference of shell 34 like end wall 36 and run against the end face of projection 38. Shell 34 acts against the cited control motion while widening. The thickness of shell 34 is operationally constant. Thereby shell 34 provides a return spring with a specific spring progression which is substantially higher than that of springs 27 to 29. As soon as unit 4 is released from the actuating force, spring 34 thus urges control face 32 back into its closed position. This venting for chamber 8 may be implemented over the full pump stroke multiply in sequence. Each time medium or liquid is sucked from the reservoir via conduit 22 and valve 25 into chamber 8 which is increasingly filled.

On reaching a sufficient level the subsequent pump stroke causes a pressure to be built up in chamber 8. At high pressure and prior to abutment of driver 46 valve body 30 is lifted off from valve seat 33 counter venting motion, namely in direction 12 and counter the spring force 29. Thereby opens an annular passage which is significantly larger than passage 40. The second medium flow, namely the fluid in chamber 8, then flows through valve 10 into duct 9. As soon as the medium pressure drops below a set critical value valve body 30 is moved back by spring 29 in direction 13 into its stop and closed position on control face 33. This motion path may be greater than the motion path for translating valve body 30 into the venting state. If, with valve body 30 opened as a function of pressure, unit 4 is moved over the full stop-limited pump stroke, then at the end thereof driver 46 can positively take along valve body 30 from the opened position into the closed position. This results in very fast closing of valve 10. On the pump stroke valve 25 will not open until the actuating force of spring 28 has overcome the counter force of spring 27.

In axis 11 unit 4, 6, 14 comprises a projection 48 centrally traversed by duct 9. Tubular stud 48 directly adjoins valve body 31 or end wall 42 and freely protrudes in direction 13. Stud 48 serves to fix a head 50 traversed by duct 9. Head 50 comprises the medium outlet 51 at which the discharged medium detaches from the despenser 1. Almost up to the end face of valve body 31 and inside stud 48 duct 9 throughout has constant cross-sections substantially larger than those of passage 40. Following the end face of valve body 31, however, (FIG. 2 and 3), duct 9 can have a stepped or similar widening. In the direction 13 following this central duct section, namely at the free end of stud 48, the central duct section translates into side ducts 49 which are offset laterally, from central duct, but oriented parallel. Ducts 49 are distributed about axis 11 and extend up to medium outlet 51 respective atomizer nozzle 52 or swirl or vortex means 52 thereof. A core body connects to the free end of stud 48 and freely protrudes in direction 13. Commonly with shell 55 of the head 50 this core body bounds ducts 49 at sides opposing each other. By its free end this core body forms a nozzle core 54 bounding at the inside of nozzle 52 the swirl device 53 which causes rotational flow of the medium about nozzle axis 11.

Like nozzle core 54 and stud 48 the rod shaped core element is integral with unit 14 on which head 50 is mounted for fitting in direction 12 so that the associated end of shell 55 firmly seates on and surrounds the outer circumference of stud 48. The other end of shell 55 forms the end wall of head 50 traversed by nozzle 52. Body section 18 protrudes in every position into head 50. For this head 50 comprises an outer shell 56 integrally adjoining shell 55 between its ends. Shell 56 spacingly surroundes the associated end of adjoining shell 55. So body section 18 is located between shells 55, 56. Shell 56 is provided with plate-type projections protruding beyond its circumference. On remote sides of axis 11 these projections form handles 57 or pressure faces for the operators fingers when urging unit 4 in direction 12 by finger pressure. The inner circumference of shell 56 is connected to the outer circumference of body section 18 via means preventing withdrawal, for example a self-latching snap-connector 58. Thereby head 50 when in rest position or unit 4 cannot be withdrawn from unit 3, 5. On start of the pump stroke the snap members of connection 58 lift off from each other and at the end of the return stroke they form the stop limit thereof.

In the interior of cap 19 a seal 59 may be provided for contacting the end face of the reservoir neck. Between casing jeckets 17, 18, namely in their common transition formed by the cap end wall, a vent 60 is provided for venting reservoir 61. Vent opening 60 traverses seal 59 and connects to an annular space bounded by and between nested shells 18, 44. After a first partial stroke the contact of piston 16 with the inner circumference of the sleeve 18 becomes sufficiently unsealed that air from without is able fo flow through head 50 via the free end of body section 18 into the cited annular space. Air then can enter reservoir 61 through vent 60. Thereby the cited venting of chambers 8, 21 is facilitated.

Instead of head 50, for example after shortening core body 54, another actuator head may also be plugged on stud 48. This actuator head comprises a radial nozzle output oriented transverse to axis 11, forming the handle 57 by its outermost end face and axially secured by the snap connector 58. Head 50 as shown in FIG. 1 serves particularly for nasal administration of the medium.

For assembling the device 1 either unit 14 or unit 5 is preassembled with unit 20 by linear insertion in direction 12. After that unit 14 is connected to unit 5 by linear insertion in direction 12. Before or after this unit 50 may also be fixedly assembled to unit 14 by linear insertion the direction 12, e.g. so that the complete preassembled unit 14, 20, 50 is to be fitted on unit 3 until connection 56 locks in place. On inserting section 45 into unit 14 the preload or resting tension of spring 29 can be precisely set by shifting section 45 more or less the shell 44, whereafter it is firmly locked by clamping or only by friction. It will be appreciated that parts configured integrally with each other may instead also be formed by separate parts fixedly connected to each other, however. All properties and effects as cited may be provided precisely as described or merely substantially or even only roughly so and may also greatly depart therefrom depending on the particular requirements in each case. Each of the cited components of the despenser 1 is made of a plastics material so that no exposed metal surfaces exist which could possibly come into contact with the media within the dispenser 1.

We claim:

1. A dispenser for discharging media comprising:

a base body (5, 6);

for controlling a fluid flow of a fluid and including a control body (30), said control body including a first control face (32) movable in first and second motion directions (12, 13);

a duct section (40) for running the fluid and defining a flow cross-section, said control body (30) operationally varying said flow cross-section to achieve an initial state when constricted and an operating state when widened with respect to said initial state;

a second control face (33) bounding said flow cross-section commonly with said first control face (32); and control means (10) for widening said flow cross-section with respect to said initial state when said first control face (32) moves in said first motion direction and when said first control face moves in said second motion direction, thereby said operating state including a first state and a second state.

2. The dispenser according to claim 1, wherein a drag is included and widens said flow cross-section (40) against a sudden rising resistance when moving in said second motion direction (13), said drag defining a highly progressive resilient force.

3. The dispenser according to claim 1, wherein one of said first and second control faces (32, 33) is resiliently deformable for widening said flow cross-section.

4. The dispenser according to claim 1, wherein in said initial state said first and second control faces (32, 33) abut each other, said control means (10) being provided for widening said flow cross-section when displaced from said initial position in said first motion direction (12) and in said second motion direction.

5. The dispenser according to claim 1, wherein said control means (10) widen said flow cross-section on said first motion direction (12) by lifting said first control face (32) off from said second control face (33), said control means widening said flow cross-section on said second motion direction (13) by continuously sliding said first control face (32) on said second control face.

6. The dispenser according to claim 1, wherein at least one of said first and second control faces includes a sliding face (32, 33) inclined with respect to at least one of said first and second motion directions (12, 13).

7. The dispenser according to claim 1, wherein at least one of said control faces (32, 33) includes an annular end face.

8. The dispenser according to claim 1, wherein at least one of said first and second control faces (32, 33) is conical.

9. The dispenser according to claim 1, wherein at least one of said first and second control faces (32, 33) includes a duct depression (41), said at least one control face (33) defining an axial extension, said duct depression (41) extending only over part of said axial extension.

10. The dispenser according to claim 1 and further including a pressure chamber (8), wherein said control means include valve means (10) including an outlet valve (10), said outlet valve opening said pressure chamber (8) on said first motion direction (12), said valve means including a vent valve for venting said pressure chamber (8) and opening on said second motion direction (13).

11. The dispenser according to claim 1 and further defining a flow direction (13) through said clow cross-section (40), said first motion direction (12) being substantially codirectional with said flow direction and said second motion direction (13) being substantially counter directional to said flow direction.

12. The dispenser according to claim 1 and further including a sleeve (34) radially deformable, wherein said first control body (30) includes said sleeve (34) defining an inner circumference, said first control face (32) directly connecting to said inner circumference.

13. The dispenser according to claim 1 and further defining a fluid pressure and a stroke motion including a motion length, wherein said control means (10) are provided for opening in said first motion direction (12) on said fluid pressure and in said second motion direction (13) on said motion length.

14. The dispenser according to claim 1 and further including an actuator (2) for manually actuating discharge of the media and defining an actuating stroke including a partial stroke, wherein a driver (46) is included and pushes against said first control body (30) after said partial stroke for driving said first control body (30) in said second motion direction.

15. The dispenser according to claim 1, wherein a stem (46) is included for positively driving said first control body (30), said stem freely projecting substantially parallel to said second motion direction (13).

16. The dispenser according to claim 1, wherein said control means (10) include resilient means (29, 34) for monostably urging said first control body (30) toward said initial state from both said first and second state.

17. The dispenser according to claim 1, wherein said resilient means define a first return force for said first state and a second return force for said second state, said second return force being significantly higher than said first return force.

18. The dispenser according to claim 1 and further including spring means operating said control means (10), wherein said spring means include first and second return springs (29, 34), said first return spring operating counter said second return spring, said first and second return springs being included in an assembly unit for being assembled with at least one of said base body (3), and said second control face (33).

19. The dispenser according to claim 1, wherein said first control body (30) is a cup including a cup sleeve (34) and a bottom wall (36), said bottom wall including an outer bottom face providing a stop.

20. The dispenser according to claim 1, wherein said first control body (30) defines a length extension, a jacket (20) being included and being longer than said length extension, said jacket emerging from said first control body (30) in said first motion direction and being displaceable commonly with said first control body.

21. The dispenser according to claim 1 and further including an actuator (2) for manually actuating discharge of the media wherein said dispenser (1) and said actuator (2) include a first unit (3) and a second unit (4) displaceable with respect to said first unit (3) over a stroke with said actuator (2), said first unit (3) including said base body (5), said second unit (4) including a pump piston (15) and an outlet duct (9) for the media, said first and second control faces (32, 33) and said second unit (4) being commonly displaceable with respect to said first unit (3).

22. The dispenser according to claim 1 and further including a piston unit (14) including a pump piston (15), wherein said first and second control faces (32, 33) are located within said pump piston (15).

23. The dispenser according to claim 1 and further including torsion means for exerting a torsional tension, wherein said torsion means torsionally tension said first control face (32, 33) on at least one of said motion directions (12, 13).

24. The dispenser according to claim 23, wherein said torsion means include a torsion spring (29).

25. The dispenser according to claim 24, wherein said torsion spring (29) includes a helix defining a steep helical pitch.

* * * * *